US008733010B2

(12) United States Patent
Ecker

(10) Patent No.: US 8,733,010 B2
(45) Date of Patent: May 27, 2014

(54) RIMLESS CARTRIDGE EXTRACTOR ASSEMBLY AND METHOD OF USE

(71) Applicant: Charter Arms, Shelton, CT (US)

(72) Inventor: D Nickerson Ecker, Milford, CT (US)

(73) Assignee: Charter Arms, Shelton, CT (US)

( * ) Notice: Subject to any disclaimer, the term of this patent is extended or adjusted under 35 U.S.C. 154(b) by 55 days.

(21) Appl. No.: 13/678,744

(22) Filed: Nov. 16, 2012

(65) Prior Publication Data

US 2014/0059912 A1 Mar. 6, 2014

Related U.S. Application Data

(60) Provisional application No. 61/629,405, filed on Nov. 19, 2011.

(51) Int. Cl.
*F41A 15/02* (2006.01)

(52) U.S. Cl.
USPC ..... 42/68; 42/59

(58) Field of Classification Search
CPC ..... F41A 15/00; F41A 15/02; F41A 9/85; F41C 3/14; F41C 3/16; F41C 3/00
USPC ..... 42/59, 60, 61, 62, 63, 67, 68
See application file for complete search history.

(56) References Cited

U.S. PATENT DOCUMENTS 3,982,346 A 9/1976 Pilorget
4,015,356 A 4/1977 Maillard
4,127,955 A * 12/1978 Curran ..... 42/68
4,541,193 A * 9/1985 Flippin ..... 42/68
4,543,741 A * 10/1985 Phillips, Jr. ..... 42/68
4,577,429 A 3/1986 Waiser
4,694,602 A * 9/1987 Pust ..... 42/59
4,934,082 A * 6/1990 Laendler ..... 42/68
5,220,115 A * 6/1993 Wales et al. ..... 42/59
5,341,587 A * 8/1994 Phillips, Jr. ..... 42/68

* cited by examiner

*Primary Examiner* — Samir Abdosh
*Assistant Examiner* — John D Cooper
(74) *Attorney, Agent, or Firm* — William J. Sapone; Ware Fressola; Maguire & Barber LLP

(57) ABSTRACT

A rimless cartridge cylinder assembly is used for adapting revolvers which typically require the use of rimmed cartridges to accept rimless cartridges. The assembly includes an extractor mechanism having an extractor rod extending axially through a center passage provided in a cylinder having chambers adapted to receive cartridges. The extractor mechanism has an axially extendable extractor head assembly disposed at a cartridge loading end of the cylinder. The head assembly includes a plurality of spring biased projections housed therein which extend radially into engagement with corresponding grooves in rimless cartridges as they are loaded into each chamber. After discharge, rearward displacement of the head assembly allows the engaged projections to remove the spent cartridges from each chamber. Utilizing the rimless cartridge cylinder assembly, rimless cartridges typically used only with automatic hand guns can be loaded and fired in a revolver with long term reliably.

20 Claims, 8 Drawing Sheets

RIMLESS CARTRIDGE EXTRACTOR ASSEMBLY AND METHOD OF USE

CROSS REFERENCE TO RELATED APPLICATIONS

This application claims priority in U.S. provisional patent application Ser. No. 61/629,405, filed Nov. 19, 2011, the contents of which are hereby incorporated by reference.

FIELD OF THE INVENTION

The present invention relates to hand guns or pistols, and more particularly to revolvers which utilize a rotating cylinder to house ammunition sequenced for firing, and which typically include an extractor assembly for quickly removing spent cartridges from the cylinder, the invention being directed to a revolver adapted to utilize and easily eject rimless cartridges.

BACKGROUND

Revolvers are primarily designed to accommodate rimmed cartridges, that is, cartridges which have a terminal rim that is larger in diameter than the diameter of the cartridge body. The rim is provided for at least partially engaging a wall of the rotating cylinder, with part of the rim received by an extractor mechanism. A typical extractor mechanism has a head for engaging the rim portion of each cartridge disposed within the chambers of the cylinder so that after the cylinder is swung out to its loading/unloading position, the extractor is pushed back with the head engaging the rim displacing the cartridges rearwardly so that all the cartridges are ejected simultaneously.

In contrast, the cartridges used in automatic pistols are rimless, that is, they have heads with an inward groove so that the heads are approximately the same diameter as the body of the cartridge. Rimmed shells or cartridges are the standard for use with revolvers. Rimless shells or cartridges are the standard for use with semi-automatic pistols.

A revolver has several advantages over semi-automatic hand guns. For example, semi-automatic hand guns must be "cocked" in order to chamber a first round in the firing breech. After the gun has been cocked, it will fire every time the trigger is pulled, i.e. with a single action, which also results in automatic discharge of the spent shell casing. Automatic pistols have a certain inherent risk, as once cocked, should the safety switch be disengaged accidentally, the gun could unintentionally discharge.

A revolver on the other hand requires a trigger pull and hammer retraction, i.e., a double action is required for discharge. Thus, a revolver which does not have to be cocked before firing, is a safer weapon, and as such, is often used as a back-up weapon by military and law enforcement personnel. However, in spite of the safety factor, the use of revolvers has been limited by the requirement of having to carry two types of ammunition, rimless cartridges for the main weapon, and rimmed cartridges for the back-up weapon.

It is quite inconvenient and expensive to maintain stocks of both rimmed and rimless ammunition, particularly when the ammunition is of the same caliber.

As the use of rimless cartridges has proliferated, efforts have been made to modify revolvers to allow utilization of rimless ammunition. In U.S. Pat. No. 4,541,193, a revolver cylinder has a central longitudinal chamber, a plurality of longitudinal cartridge chambers and radial slots at the rear of each cartridge receiving cylinder for communicating between the central chamber and each cartridge chamber. An ejector assembly disposed in the central chamber has a plurality of radial projections disposed at the end of extraction fingers which engage the grooves of each rimless cartridge. However, the size of the ejector components requires a relatively large central bore, which can reduce cylinder strength.

In U.S. Pat. No. 4,015,356, spring clips are used to retain rimless cartridges in a revolver cylinder. However, these are prone to breakage and jamming, and so have not gained wide acceptance.

In U.S. Pat. Nos. 4,127,955, 4,934,082 and 5,341,587, various spring fingers are disclosed for use in adapting a revolver cylinder for receiving and ejecting rimless cartridges. However, these still suffer from problems of uniform discharge and ejection, and possible reduction of cylinder strength, and so, generally, none of these solutions has gained wide acceptance in the industry.

Other background related information on revolvers and extractors can be found in U.S. Pat. Nos. 3,982,346 and 4,577,429.

What is needed is a low cost yet reliable cylinder assembly which includes an extractor mechanism that will permit use of rimless cartridges in revolvers without requiring a large central bore that could reduce cylinder strength. It is also desired to have a cylinder assembly which includes an extractor mechanism that is sufficiently robust so as to avoid jamming and breakage for the life of the revolver.

SUMMARY OF THE INVENTION

The object of the present invention is to provide a mechanical device that will allow rimless cartridges to be used with revolvers which typically require rimmed cartridges.

It is a further object to provide a novel cylinder assembly for a revolver that is adapted to receive rimless cartridges, having an extractor mechanism that provide for reliable cartridge extraction for the life of the revolver.

These are other objects of the present invention are achieved by a cylinder assembly which includes a cylinder for use in a revolver, the cylinder having a plurality of cartridge receiving chambers, the cylinder assembly adapted to receive rimless cartridges. An extractor mechanism is provided with the cylinder, having an ejector rod extending axially through a center passage provided in the cylinder, the extractor mechanism having an extraction head assembly disposed at a loading end of the cylinder. The head assembly includes a plurality of spring biased projections housed therein which are extendable radially into engagement with a plurality of grooves in rimless cartridges when the cartridges are loaded into each chamber. Utilizing the novel cylinder assembly including the inventive extractor mechanism, rimless cartridges typically used only with automatic hand guns can conveniently be loaded and fired in a revolver with long term reliably and without compromising cylinder strength.

The inventive rimless cartridge cylinder assembly can be adapted for use in many revolvers of differing caliber, so that revolvers can conveniently accept rimless cartridges over a wide caliber range, including relatively large caliber rimless cartridges, having diameters of 40 caliber, 45 caliber and 9 mm, among others.

In a preferred embodiment, the extractor mechanism has a plurality of dual coil spring projection assemblies, one assembly associated with each chamber, and facing into each chamber bore. Each projection is biased outwardly by the dual coil springs, with the two springs applying a balanced force to the projection, which has an arcuate shaped forward end sized to fit within a groove of a rimless cartridge. Each projection resides within a passage in the extractor head assembly, each projection being radially slidable therein. The projection when fully extended outwardly, extends past a forward edge of the head assembly, in response to spring pressure exerted on the projection. When the spring bias is overcome, such as when a cartridge is being loaded into the chamber, the projection is displaced inwardly such that the forward edge of the projection substantially coincides with the forward edge of the head assembly which in turn, coincides with a wall of the chamber. When the groove of the rimless cartridge is adjacent the projection, the projection, responding to the spring pressure, enters the groove and locks the rimless cartridge in position. As all the operative components are located in the head assembly, an ejector rod used to displace the head assembly during cartridge extraction can have a relatively small diameter, and thus, the cylinder itself does not require a relatively large diameter central passage, but rather a passage only large enough to contain the ejector rod and a keyed support tube therein, as will be discussed further below.

The extractor head assembly resides within a correspondingly shaped depression provided in a loading end of the cylinder. The head assembly contains a plurality of arcuate sections, one for each cylinder, which in essence form part of the bore of the chamber, as the arcuate sections have a curvature matching the curvature of each cylinder bore. Each arcuate section includes a passage which house a projection and supporting dual coil springs. The head assembly itself is spring biased, so that the head assembly will reside snuggly within the shaped depression, and only be axially displaced away from the loading end of the cylinder when manual pressure is applied to the extractor rod so as to force displacement rearwardly to a sufficient extent to allow release of spent cartridges after the cylinder assembly has been swung away from a firing position with the cylinder assembly locked to the revolver, to a loading/unloading position, where all the chambers are exposed. During loading and firing, the head assembly is substantially flush with the end cylinder wall, assuring that the head assembly does not interfere with cylinder rotation during firing.

Rimless cartridges are loaded into each chamber of the cylinder through the entry opening defined by the cylinder and arcuate section of the extractor head assembly. When a cartridge is loaded, the dual coil springs permit inward displacement of the respective projection, allowing passage of the cartridge into the cylinder chamber. When the cartridge is fully received in the chamber, the spring assembly forces the projection to engage the adjacent groove to lock the rimless cartridge in place. After firing, the spend cartridges are removed by use of the extractor assembly, by driving the ejector rod rearwardly to displace the extractor head rearwardly, the projection still located in the groove forcing the cartridge out of the chamber. Once the cartridge clears the end loading wall of the cylinder, the projection extends further outwardly to force the cartridge away from the head assembly, so that the spent cartridge falls freely away from the cylinder assembly. The extractor head assembly then returns to its seating on the loading end of the cylinder, with the cylinder then ready for reloading.

Utilizing the present invention provides a solution to the inability of revolvers to accommodate rimless cartridges, the present invention being usable with virtually any caliber of rimless ammunition, including 40 caliber, 45 caliber and 9 millimeter rimless cartridges.

BRIEF DESCRIPTION OF THE DRAWINGS

The accompanying drawings illustrate embodiments of the present invention and, together with the description, serve to explain the principles of the invention, though the embodiments illustrated should not be read to constitute limiting requirements, but instead are intended to assist the reader in understanding the invention.

DETAILED DESCRIPTION OF THE INVENTION

Figure 1:
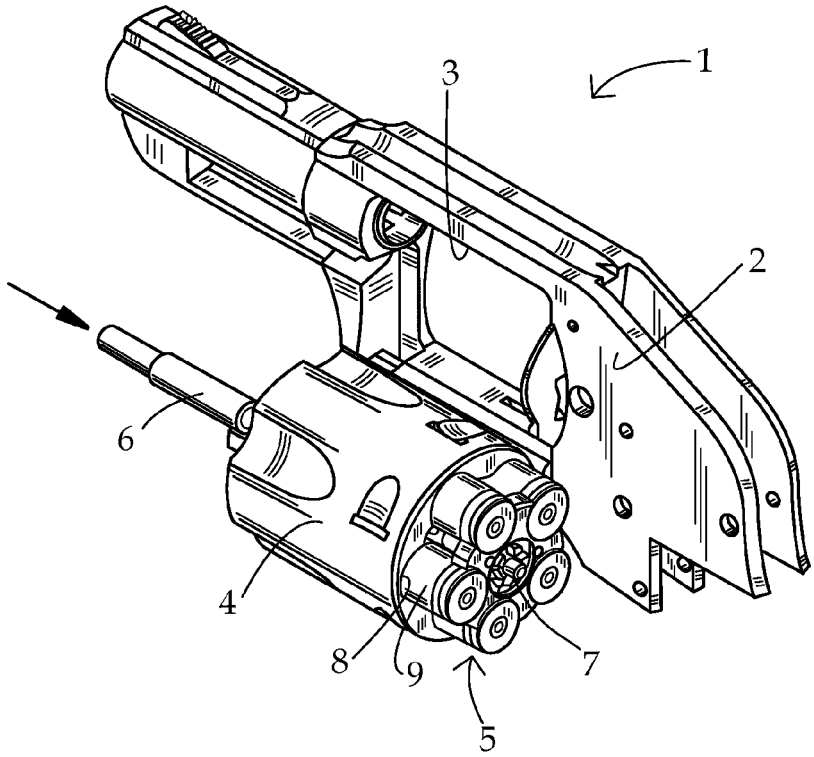
FIG. 1 is perspective drawing illustrating the components of a revolver including a cylinder assembly utilizing the extractor mechanism of the present invention.

Referring to FIG. 1, a revolver 1 includes a main body 2 having an opening 3 for receiving a cylinder 4 which is hingedly mounted to the main body so as to allow the cylinder to swing into a firing position with the cylinder received in the opening, and to swing out to a loading/unloading position, as is illustrated. An extractor mechanism 5 is mounted centrally within the cylinder, having an ejector rod 6 connected to an extractor head assembly 7 which is axially displaceable rearwardly. In this illustration, the cylinder contains five chambers 8 with five spent cartridges 9 being engaged to the head assembly 7 moving rearwardly to a cartridge ejection position, as will be discussed more fully below.

Figure 2:
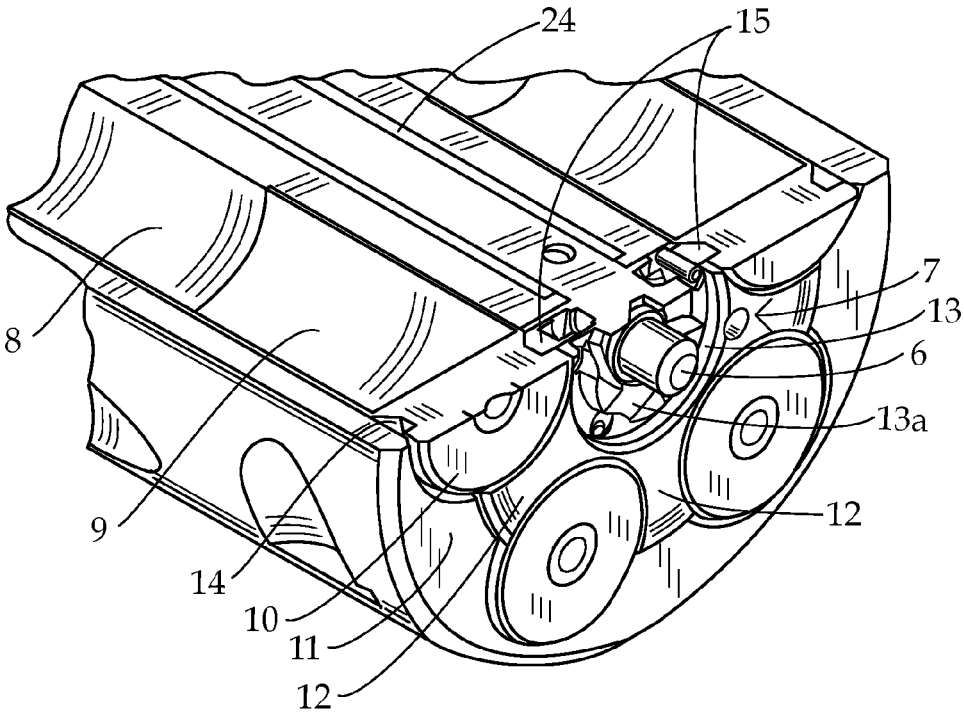
FIG. 2 shows a sectional perspective view of a spent rimless cartridge located in a revolver cylinder and engaged by the extractor mechanism.

Referring to FIG. 2, a sectional view of the cylinder 4 shows the rimless spent cartridge 9 disposed in the chamber 8 prior to extraction, the spent cartridge having a rear surface 10 that is substantially flush with a loading end surface 11 of the cylinder 4. The extractor head assembly has a plurality of arcuate sections 12 located between adjacent chambers, similarly substantially flush with the end surface 11 of the cylinder. The arcuate sections extend from a hub 13 which includes ratchet structures 13*a* for rotating the cylinder, the hub being connected to the ejector rod 6. Each rimless cartridge has a groove 14, a projection 15 extending from the head assembly into the groove locking the rimless cartridge in the chamber 8.

Figure 3:
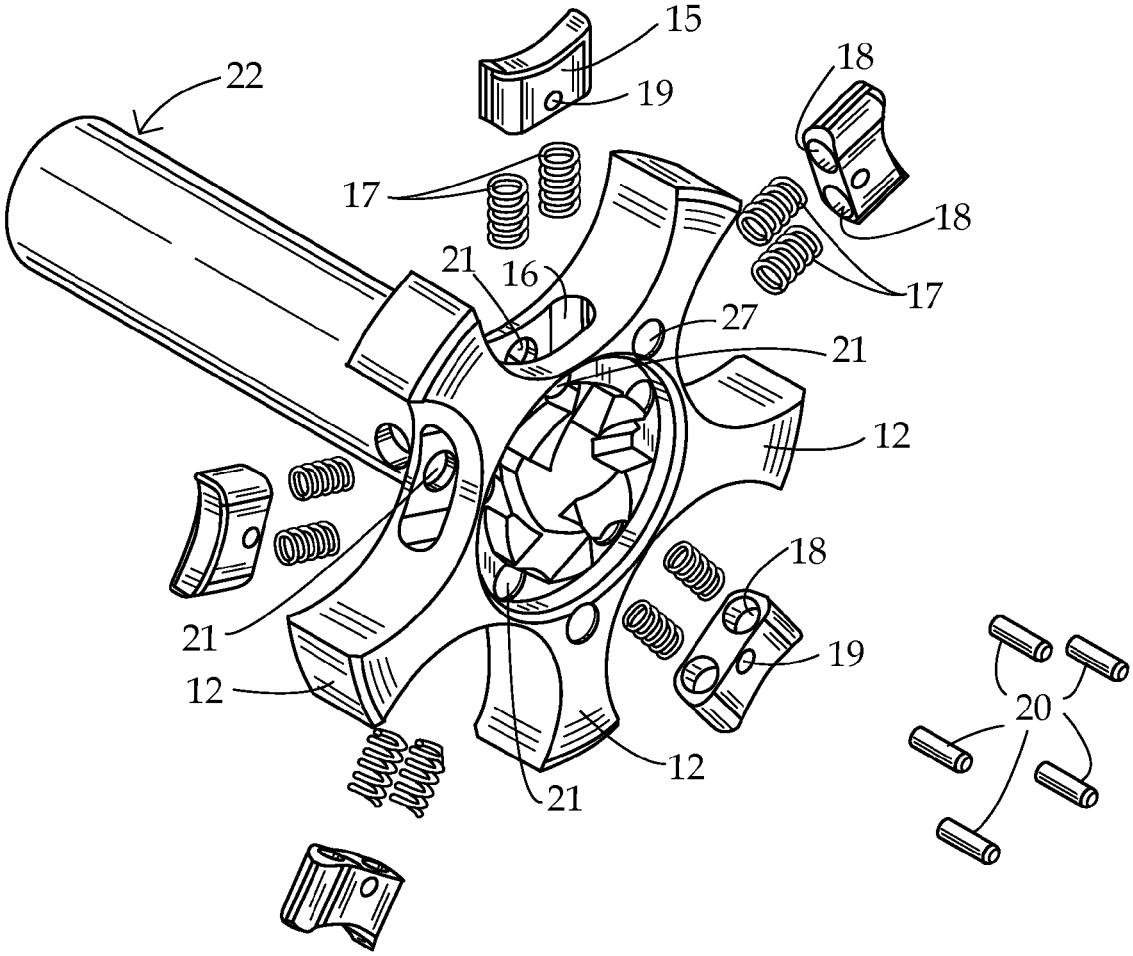
FIG. 3 a perspective exploded illustration of the extractor mechanism including the dissembled components forming the extractor head assembly.
Figure 6A:
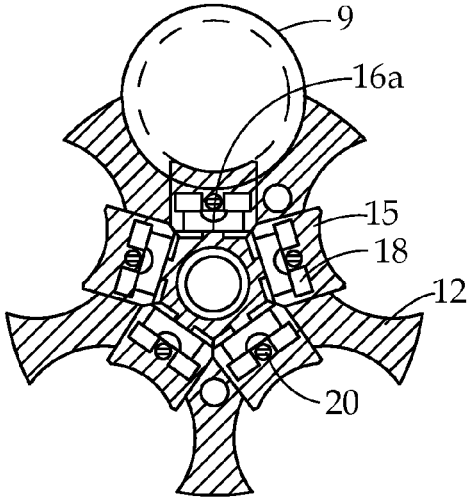
FIGS. 6*a* and 6*b* illustrate the selected limit to the range of movement of the projection within the head assembly.
Figure 6B:
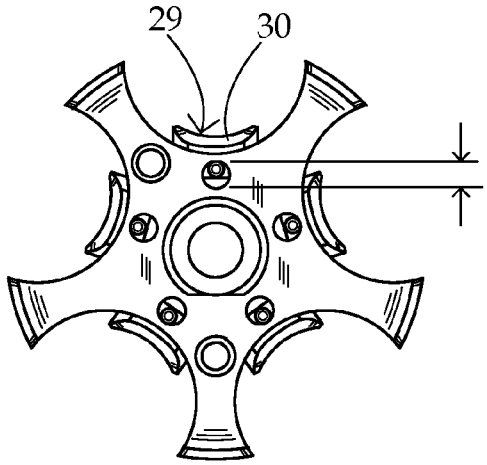

Referring to FIG. 3, an exploded view of the components forming the extractor head assembly is shown. Each arcuate section 12 has a passage 16 in a central portion thereof which has a bottom surface 16*a* (see FIG. 6*a*) for supporting a pair of springs 17. In turn, each projection has a pair of spring receiving recesses 18 that receive ends of the coil springs therein, the recesses assuring proper alignment to prevent binding. Each projection further has a pin receiving passage 19 which permits a pin 20 to be mounted therein, preferably by pressing with a slight interference fit. Each passage 16 has a pair of facing holes 21. The dual spring projection assembly is thus attached to the head assembly by locating the springs in the projection end receiving recesses, pressing the projection into the passage 16 so that the holes 21 are aligned with the pin receiving passage 19, with the pin 20 then inserted therein. The pin has a length sufficient to have ends which reside within the holes 21. Thus, the range of axial movement of the projection within the passage is limited by the size of the openings of the pair of holes 21, as the pin ends engage the outer and inner hole surfaces, as best seen in FIG. 6*b*.

The hub is connected to a support tube 22 through which the ejector rod passes, the support tube having a flat surface 23 which extends axially, the support tube residing in a central axial passage 24 provided in the cylinder. The flat surface engages a corresponding flat surface in the passage 24 so as to prevent rotation of the head assembly during ejection of the spent cartridges. A spring (not shown) disposed within the central axial passage, surrounds the ejector rod for biasing the extractor head towards residence in a shaped depression 26 provided on the end surface 11 of the cylinder, the shape corresponding to the shape of the head assembly which is receivable therein. The head assembly further includes a pair of alignment holes 27 which mate with a pair of stems 28 located in the shaped depression 26 (see FIG. 14), the stems and alignment holes assuring that the extractor head is precisely positioned in the depression after each displacement of the head assembly therefrom.

Figure 4:
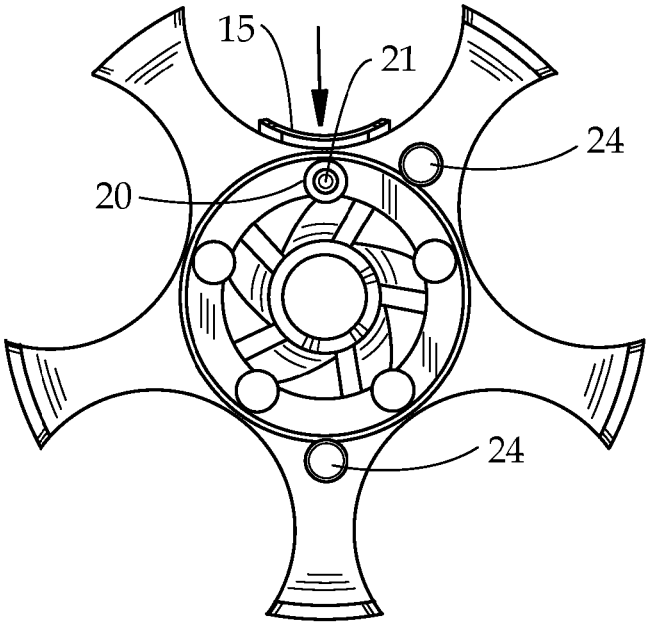
FIG. 4 is a view illustrating the spring action occurring within the extractor head assembly during entry of a cartridge into a chamber.
Figure 5:
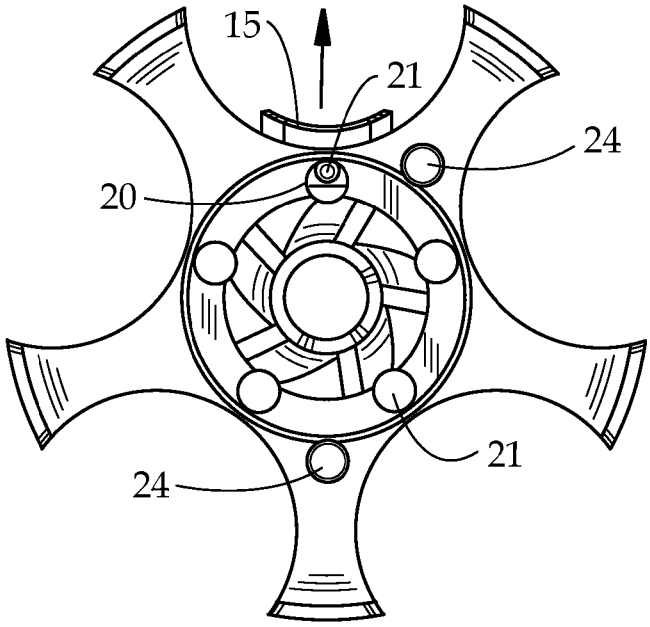
FIG. 5 is a view illustrating the spring action occurring within the extractor head assembly during ejection of a spent cartridge.
Figure 7:
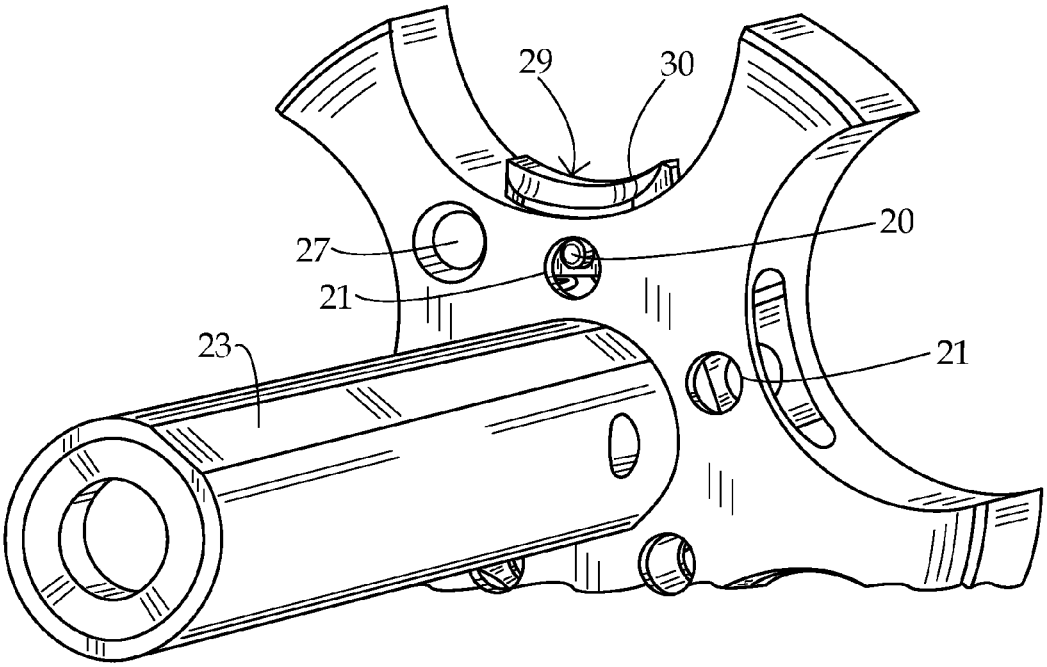
FIG. 7 is a rear perspective view of the head assembly.

Referring to FIGS. 4 and 5, FIG. 4 shows the location of the pin 20 in a hole 21 when the projection 15 travels inwardly in response to a cartridge being loaded in a chamber. FIG. 5 shows how the pin limits the travel of the projection by engaging a wall of hole 21. Thus, the range of motion is easily determined and set by a simple drilling operation. FIGS. 6*a*, 6*b* and 7 provide additional views illustrating the operation of the pin mounting and movement system, FIG. 6*a* showing a cartridge 9 having received a projection 15 in a groove thereof, with the springs removed for ease in illustration. FIG. 7 shows the inner surface of the head assembly, to better show the inner of the pair of holes 21 engaging the pin 20, and to also show an end 29 of the projection, which is arcuate shaped to match the circumference of a rimless cartridge groove, which also has a tapered surface 30 to match as well a corresponding surface provided in the groove of the rimless cartridge.

Figure 8:
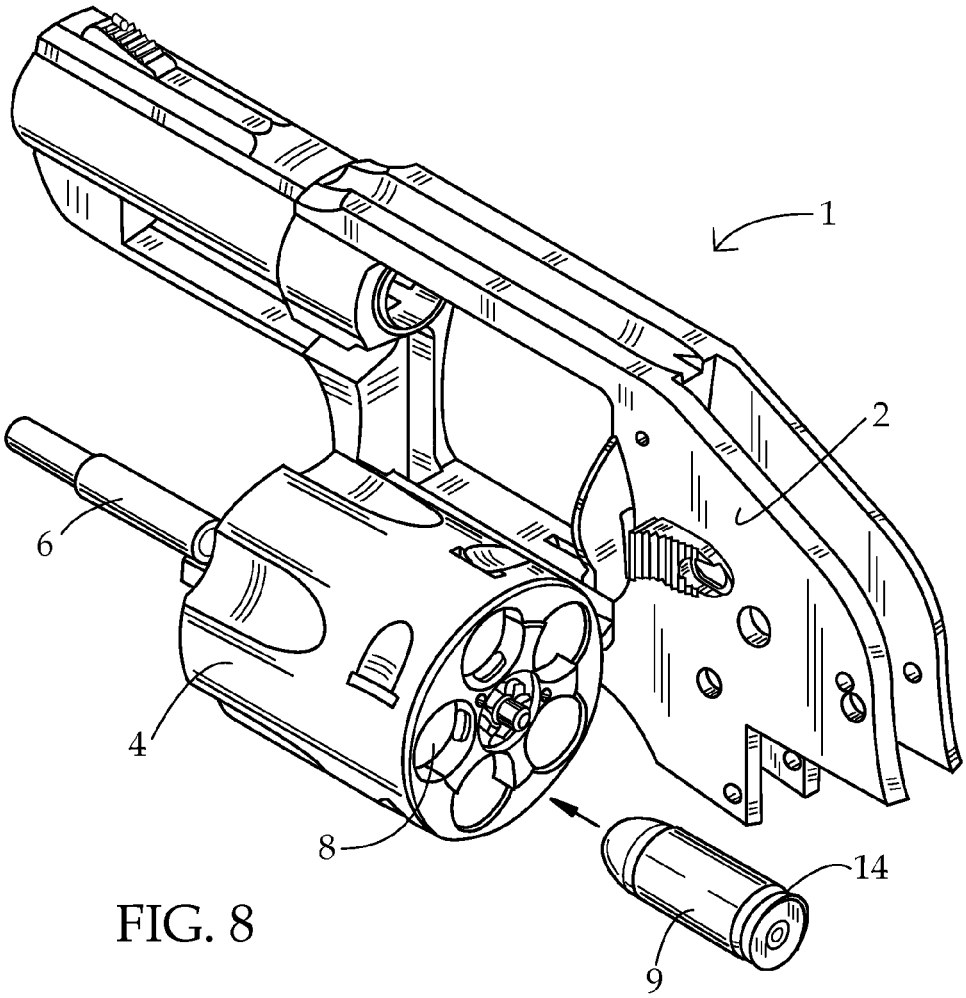
FIG. 8 is a perspective view illustrating the loading of a cylinder chamber with a rimless cartridge.
Figure 9:
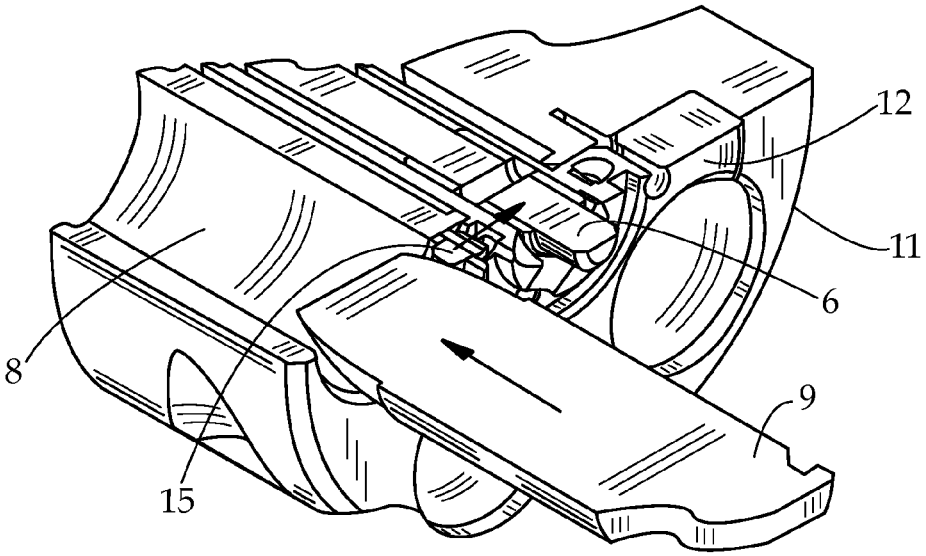
FIG. 9 is an enlarged sectional view illustrating the displacement of the projection inwardly during loading of the cartridge into the chamber.
Figure 10:
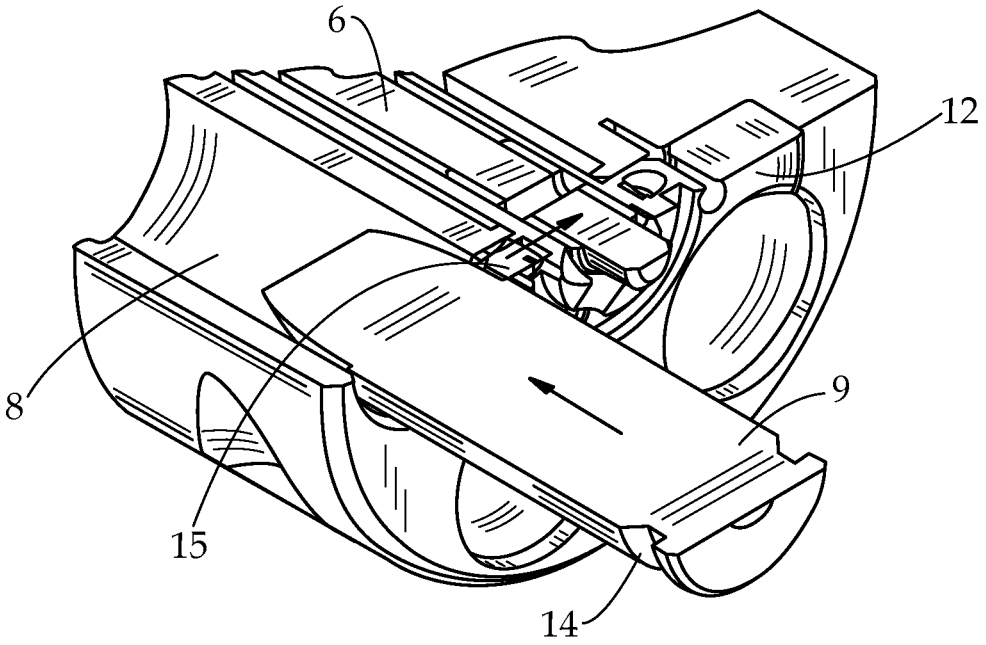
FIG. 10 is an enlarged sectional view illustrating the further displacement of the projection by the cartridge during loading of the cartridge into the chamber.
Figure 11:
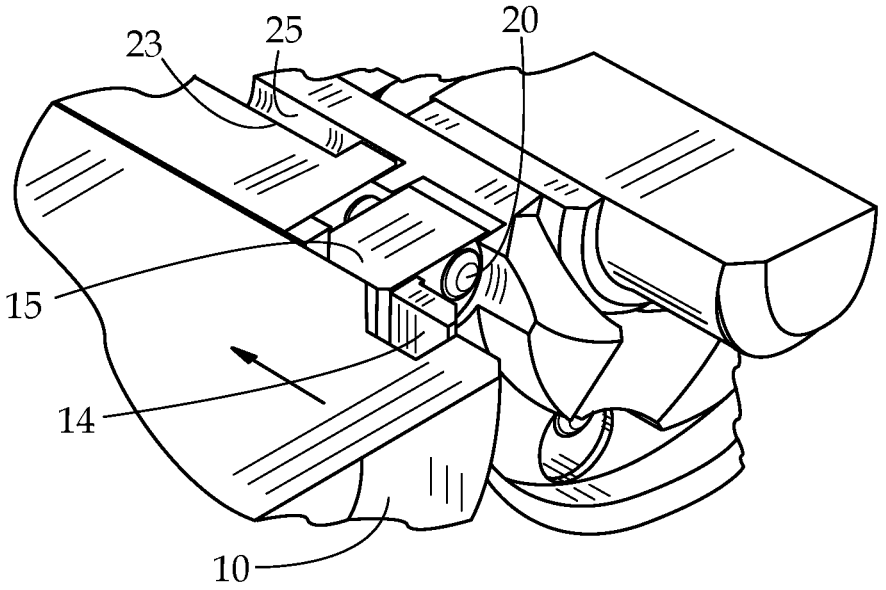
FIG. 11 is an enlarged sectional view illustrating the displacement of the projection just prior to entry of the cartridge fully into the chamber.
Figure 12:
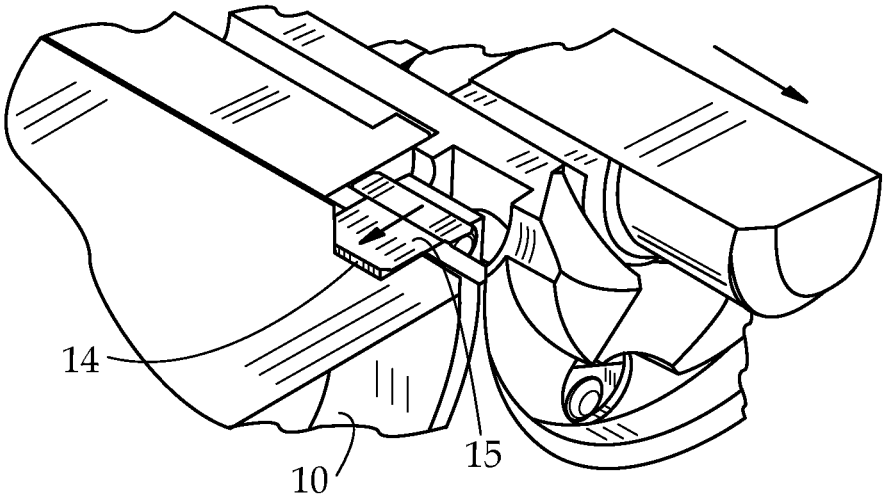
FIG. 12 is an enlarged sectional view illustrating the locking of the cartridge in the chamber with the projection disposed within the groove of the rimless cartridge.
Figure 13:
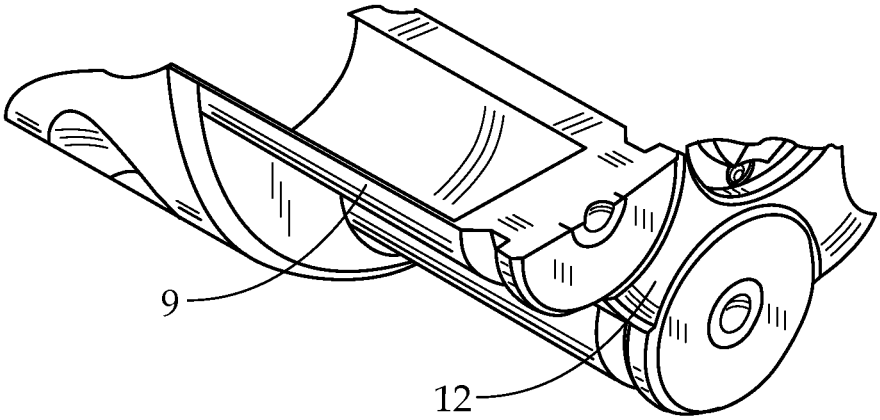
FIG. 13 is an enlarged sectional view illustrating the extraction of the spent rimless cartridge by the extractor assembly just prior to release; and, FIG. 14 is a perspective view illustrating the release of a spent rimless cartridge from the extractor assembly.
Figure 14:
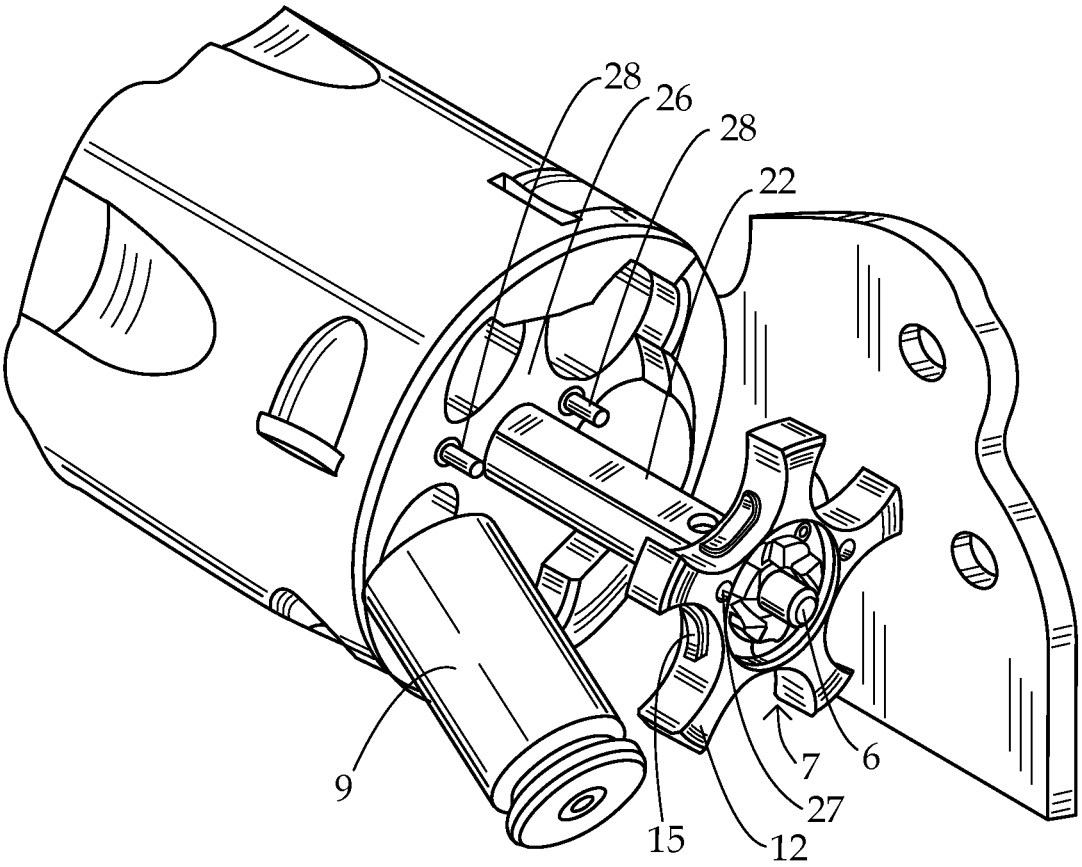

Referring to FIG. 8, a cartridge 9 is shown just prior to being loaded into a chamber 8, with the projections in the empty chambers fully extended. FIG. 9 shows the cartridge with a bullet end thereof beginning the inward displacement of the projection 15 as it moves into the chamber 8. FIG. 10 shows the projection nearly fully displaced inwardly into passage 16, with FIG. 11 in enlarged fashion showing the projection fully displaced just prior to alignment with the groove 14 of the rimless cartridge 9. FIG. 12 shows the engagement of the spring biased projection 15 into the groove 14, with the end and tapered surface 30 of the projection engaged with corresponding surfaces in the groove. FIG. 13 shows the extraction of the cartridge 9 just prior to disengagement from the cylinder. FIG. 14 shows the extractor assembly when fully displaced rearwardly, with the spent cartridge, once it clears the end of the cylinder, being released, the spring biased projection 15 assisting in the release by moving outwardly to assure that the spent cartridge is displaced away from the extractor head 7. Note that all the projections in the extractor head assembly are then in their fully outward position, and once the head assembly is reseated in the shaped depression 26, the cylinder is ready for reloading.

Although the present invention describes in detail certain embodiments, it is understood that variations and modification exist known to those skilled in the art to which this invention applies that are within the invention. Accordingly, the present invention is intended to encompass all such alternatives, modifications and variations that are within the scope of the invention as set herein. Specific terminology used in the description of specific embodiments is for the purpose of illustration and not to limit the scope of the invention.

The invention claimed is:

1. A rimless cartridge cylinder assembly for use in a revolver comprising:

a cylinder having a plurality of cartridge receiving chambers;

an extractor mechanism provided with the cylinder, and having an extractor rod extending axially through a center passage in the cylinder, the extractor mechanism having an extractor head assembly disposed at a loading end of the cylinder, and received in a depression such that the extractor head assembly is substantially flush with an end surface of the cylinder, the head assembly including a plurality of spring biased projections housed therein which extend radially into each of the cartridge receiving chambers, the plurality of projections adapted to engage with a corresponding plurality of grooves in rimless cartridges loaded into each chamber, the head assembly being axially displaceable in a rearward direction such that the projections engaged with the grooves displace the cartridges rearwardly for extracting the cartridges from the chambers; and, wherein the extractor head assembly includes pairs of coil springs, each pair of coil springs supporting and biasing outwardly a single projection, the pair of coil springs applying a balanced spring force to the projection.

2. The rimless cartridge cylinder assembly of claim 1 wherein each projection has a pair of recesses for receiving ends of the pair of coil springs.

3. The rimless cartridge cylinder assembly of claim 1 wherein each projection is has an arcuate shaped forward end sized to fit within a groove of a rimless cartridge.

4. The rimless cartridge cylinder assembly of claim 1 wherein each projection has a limiting device to define a constrained range of displacement relative to the head assembly.

5. The rimless cartridge cylinder assembly of claim 1 wherein the head assembly is spring biased into engagement with the depression, the depression including an alignment device for maintaining alignment of the head assembly with the plurality of chambers.

6. The rimless cartridge cylinder assembly of claim 5 wherein the alignment device is at least one aligning pin receivable in an alignment opening.

7. A rimless cartridge cylinder assembly for use in a revolver comprising:

a cylinder having a plurality of cartridge receiving chambers;

an extractor mechanism provided with the cylinder, and having an extractor rod extending axially through a center passage in the cylinder, the extractor mechanism having an extractor head assembly disposed at a loading end of the cylinder, and received in a depression such that the extractor head assembly is substantially flush with an end surface of the cylinder, the head assembly including a plurality of spring biased projections housed therein which extend radially into each of the cartridge receiving chambers, the plurality of projections adapted to engage with a corresponding plurality of grooves in rimless cartridges loaded into each chamber, the head assembly being axially displaceable in a rearward direction such that the projections engaged with the grooves displace the cartridges rearwardly for extracting the cartridges from the chambers; and, wherein each projection resides within a passage in the extractor head assembly, each projection being radially slidable therein, the projection adapted to extend outwardly past a forward edge of the head assembly, the passage having a depth sufficient to permit the projection to be fully received therein such that the forward edge of the projection substantially coincides with the forward edge of the head assembly.

8. The rimless cartridge cylinder assembly of claim 7, wherein the head assembly has a plurality of arcuate portions which align with walls of the cylinder chambers, when the head assembly is disposed within the shaped depression.

9. The rimless cartridge cylinder assembly of claim 7 wherein the extractor head assembly includes pairs of coil springs, each pair of coil springs supporting and biasing outwardly a single projection, the pair of coil springs applying a balanced spring force to the projection.

10. The rimless cartridge cylinder assembly of claim 9 wherein each projection has a pair of recesses for receiving ends of the pair of coil springs.

11. The rimless cartridge cylinder assembly of claim 7 wherein each projection is has an arcuate shaped forward end sized to fit within a groove of a rimless cartridge.

12. The rimless cartridge cylinder assembly of claim 7 wherein each projection has a limiting device to define a constrained range of displacement relative to the head assembly.

13. The rimless cartridge cylinder assembly of claim 7 wherein the head assembly is spring biased into engagement with the depression, the depression including an alignment device for maintaining alignment of the head assembly with the plurality of chambers.

14. The rimless cartridge cylinder assembly of claim 13 wherein the alignment device is at least one aligning pin receivable in an alignment opening.

15. A rimless cartridge cylinder assembly for use in a revolver comprising:

a cylinder having a plurality of cartridge receiving chambers;

an extractor mechanism provided with the cylinder, and having an extractor rod extending axially through a center passage in the cylinder, the extractor mechanism having an extractor head assembly disposed at a loading end of the cylinder, and received in a depression such that the extractor head assembly is substantially flush with an end surface of the cylinder, the head assembly including a plurality of spring biased projections housed therein which extend radially into each of the cartridge receiving chambers, the plurality of projections adapted to engage with a corresponding plurality of grooves in rimless cartridges loaded into each chamber, the head assembly being axially displaceable in a rearward direction such that the projections engaged with the grooves displace the cartridges rearwardly for extracting the cartridges from the chambers;

wherein each projection has a limiting device to define a constrained range of displacement relative to the head assembly and, wherein the limiting device is a pin disposed in a passage provided in each projection, the head assembly having an opening within which a portion of the pin is movable, the size of the opening defining the range of motion of the pin and thereby of the projection.

16. The rimless cartridge cylinder assembly of claim 15 wherein the extractor head assembly includes pairs of coil springs, each pair of coil springs supporting and biasing outwardly a single projection, the pair of coil springs applying a balanced spring force to the projection.

17. The rimless cartridge cylinder assembly of claim 16 wherein each projection has a pair of recesses for receiving ends of the pair of coil springs.

18. The rimless cartridge cylinder assembly of claim 15 wherein each projection is has an arcuate shaped forward end sized to fit within a groove of a rimless cartridge.

19. The rimless cartridge cylinder assembly of claim 15 wherein each projection resides within a passage in the extractor head assembly, each projection being radially slidable therein, the projection adapted to extend outwardly past a forward edge of the head assembly, the passage having a depth sufficient to permit the projection to be fully received therein such that the forward edge of the projection substantially coincides with the forward edge of the head assembly.

20. A method for adapting rimless cartridges for use in a revolver comprising:

providing a cylinder having a plurality of cartridge receiving chambers;

placing an extractor mechanism having an extractor rod in the cylinder, axially extending through a center passage in the cylinder, locating an extractor head assembly on a loading end of the cylinder, connected to the extractor rod and disposing the extractor head assembly in a depression formed in the cylinder, placing a plurality of spring biased projections in the extractor head assembly, the projections being reciprocally movable therein, each projection adapted to engage a groove of a rimless cartridge, spring biasing each projection radially into each of the cartridge receiving chambers applying a balanced outwardly biased spring force to each projection using a pair of coil springs, the pair of coil springs permitting inwardly moving each projection into the extractor head assembly during cartridge loading, and permitting outwardly moving each projection to engage a groove of a rimless cartridge when the groove is adjacent thereto, wherein axially displacing the extractor rod in a rearward direction such that causes the projections engaged with the grooves to displace the cartridges rearwardly, the coil springs moving the projections outwardly to displace the cartridges from the extractor head assembly.

* * * * *